United States Patent [19]

Burger et al.

[11] 3,971,679

[45] July 27, 1976

[54] METHOD OF ANNEALING ORIENTED SILICON STEEL

[75] Inventors: John H. Burger; John R. McClelland, both of Butler; Robert P. Dunkle, Kittanning, all of Pa.

[73] Assignee: Armco Steel Corporation, Middletown, Ohio

[22] Filed: Sept. 2, 1975

[21] Appl. No.: 609,189

[52] U.S. Cl. ..... 148/113; 148/13.1; 148/112; 266/106; 13/1

[51] Int. Cl.[2] ..... H01F 1/04

[58] Field of Search ..... 148/113, 112, 111, 121, 148/13.1, 16.7; 266/13; 13/1

[56] References Cited

UNITED STATES PATENTS 3,588,305 6/1971 Seelandt ..... 13/1

*Primary Examiner*—Walter R. Satterfield

*Attorney, Agent, or Firm*—Melville, Strasser, Foster & Hoffman

[57] ABSTRACT

A batch-type method of annealing large coils of silicon steel for magnetic purposes in an annealing furance of the type comprising an outer enclosure surrounding an insulated heating chamber in which the coils are supported, the furnace being capable of subjecting the coils both to a desired atmosphere and a vacuum. The method comprises the steps of locating the coils to be annealed in the furnace heating chamber; drawing and holding a vacuum within the outer enclosure and heating chamber to remove air therefrom; backfilling with a desired non-oxidizing annealing atmosphere; circulating the annealing atmosphere through the outer enclosure and heating chamber; heating the coils to a temperature of about 2200°F. (1204°C.) and soaking the coils at temperature with continued annealing atmosphere circulation; subjecting the coils to an initial, slow, unassisted cooling step down to about 1700°F. (927°C.); subjecting the coils to an intermediate cooling step down to about 1225°F. (663°C) with the furnace fans on and the furnace bungs closed; subjecting the coils to a final fast cooling step down to about 250°F. (121°C.) with the furnace fans on and the furnace bungs open; drawing and holding a vacuum within the outer enclosure and heating chamber to remove the annealing atmosphere therefrom; backfilling with nitrogen and removing the coils from the furnace. When the silicon steel for magnetic purposes is to have a cube-on-edge orientation and contains Aln as the grain growth inhibitor, the coils may be held at 1200°F. (649°C.) for about 6 hours prior to heating them to 2200°F. (1204°C.) and the soaking step.

13 Claims, 5 Drawing Figures

METHOD OF ANNEALING ORIENTED SILICON STEEL

BACKGROUND OF THE INVENTION

1. Field of the Invention

The invention relates to an improved batch-type method of annealing large coils of silicon steel for magnetic purposes, and more particularly to such an annealing method utilizing a furnace of the type taught in U.S. Pat. No. 3,588,305.

2. Description of the Prior Art

As used herein and in the claims, the term "silicon steel" relates to an alloy, the typical composition of which by weight percent falls within the following:

| | |
|---|---|
| carbon | 0.060% maximum |
| silicon | 2–4% |
| sulfur or selenium | 0.03% maximum |
| manganese | 0.02–0.4% |
| aluminum | 0.04% maximum |
| iron | balance |

At the present time, there is a great demand for silicon steels fo sheet gauge for magnetic uses such as lamination cores for transformers and the like. While not intended to be so limited, for purposes of an exemplary showing the present invention will be described in terms of the production of cube-on-edge oriented silicon steel. It will be understood that cube-on-face oriented silicon steel, for example, can be produced by the present invention.

In general, the production of cube-on-edge oriented silicon steel includes the steps of hot rolling ingots or slabs of a suitable composition to an intermediate gauge, pickling and heat treating the hot-rolled product, cold rolling to final gauge in one or more cold rolling stages (with intermediate anneals if in multiple stages), decarburizing, coating with an annealing separator and subjecting the steel to a final anneal consisting of a primary grain growth stage and a secondary grain growth stage. The present invention is directed to the final anneal and is not limited to the various processing steps practiced prior to the final anneal. It is during the final anneal that the desired orientation is achieved. In cube-on-edge oriented silicon steel the body-centered cubes making up the grains or crystals are oriented in the cube-on-edge position, designated (110)[001] in accordance with Miller's indices.

The development of the cube-on-edge orientation is achieved by the grain boundary phenonemon which requires the presence of a grain growth inhibitor at the grain boundaries during the primary grain growth stage of the final anneal. Manganese sulfides and manganese selenides are typical inhibitors formed for this purpose. The manganese and sulfur or selenium content of the initial melt may be such as to assure the presence of manganese sulfides or manganese selenides at the grain boundaries during the primary grain growth stage of the final anneal. On the other hand, as taught in U.S. Pat. No. 3,333,991, 3,333,992 and 3,333,993 sulfur, selenium or compounds thereof may be provided in the annealing atmosphere or in the annealing separator. Similarly, sulfur, selenium or compounds thereof may be made available at the surfaces of the steel during a decarburizing anneal prior to the final anneal. In any event, the sulfur or selenium will defuse to the grain boundaries forming inhibitors during the primary grain growth stage of the final anneal. As is known in the art A1N may also be used as a grain growth inhibitor.

In the usual prior art practice, coils of silicon steel weighing from 10,000 to 15,000 pounds were annealed in dry hydrogen in a muffle or box at a temperature of about 2200°F.

More recently, semi-continuous annealing furnaces have been developed for the annealing of silicon steel. U.S. Pat. No. 3,756,868 teaches such a furnace comprising a massive two-level structure wherein individual cars, each carrying a coil, are continuously caused to enter the furnace through a vestibule and exit the furnace through the same vestibule. The furnace itself comprises various sections including an initial heat section, an initial soak section, a final heat section, a final soak section and some five cooling sections. Each car carrying a coil to be annealed enters the vestibule which is then purged by nitrogen gas. The vestibule is then filled with hydrogen gas and the car proceeds through the remainder of the furnace, having a hydrogen gas atmosphere therein.

At the end of the furnace, the car and coil to be removed reenters the vestibule which is again purged with nitrogen prior to removal of the car therefrom.

In U.S. Pat. No. 3,778,221 a somewhat similar arrangement is shown. In this patent a semi-continuous annealing furnace is taught having an entrance vestibule, an initial heat section, a transfer station, an initial soak section, a final heat section and a final soak section followed by some five cooling sections and a separate exit vestibule. In accordance with the teachings of this patent, again cars pass continuously through the furnace, each car bearing a coil of silicon steel. A car carrying a coil to be annealed enters the entrance vestibule which is evacuated to remove gaseous impurities and air therefrom. The entrance vestibule is then charged with hydrogen followed by a second evacuation. The initial heating section of the furnace is also evacuated and separated from the remainder of the hydrogen-filled furnace by the transfer station. As a car is about to leave the furnace, it enters the exit vestibule which is then evacuated. Following evacuation, the vestibule is filled with nitrogen or air and opened for removal of the car and coil.

By virtue of the increased demand for oriented silicon steel, it would be advantageous to the steel manufacturer to be able to anneal the silicon steel in very large coils ranging from 30,000 to 40,000 pounds or more per coil. The present invention is directed to the batch-type annealing of such very large coils in a furnace of the type taught in U.S. Pat. No. 3,588,305. Typical prior art procedures involving a muffle or box were not intended for the annealing of such very large coils. The more recent semi-continuous annealing procedures require larger and more complex equipment utilizing a more complex annealing process.

SUMMARY OF THE INVENTION

The batch-type method of the present invention for annealing large coils of silicon steel for magnetic purposes is directed to the use of an annealing furnace of the type taught in U.S. Pat. No. 3,588,305. As will be described hereinafter, such an annealing furnace comprises an outer enclosure surrounding an insulated heating chamber in which the coils are supported. The furnace is capable of subjecting the coils both to a desired atmosphere and to a vacuum.

The anneal in question is the final anneal during which the desired magnetic properties of the silicon steel are developed. As indicated above, the processing of the silicon steel prior to the final anneal may be conventional and may be accomplished by any appropriate routing known in the art. As is customary, the silicon steel will be provided with an annealing separator, again as is well known in the art.

The coils to be annealed are placed on a car and transferred into the heating chamber of the furnace and the furnace is closed and sealed. A vacuum is drawn within the furnace enclosure and the heating chamber to remove air therefrom. This is followed by back-filling with a desired non-oxidizing annealing atmosphere, such as hydrogen. Throughout the heat-up, soak and cooling portions of the anneal, the annealing atmosphere is circulated through the furnace, exiting the furnace to a flare stack or appropriate recovery means. The heating elements of the furnace are then energized and the coils are brought to a temperature of about 2200°F. (1204°C.) and are caused to soak at that temperature for an appropriate length of time. Following the soak step, the heating elements of the furnace are de-energized and the coils are cooled in three steps. Accordingly, the coils are first subjected to an initial slow cooling step at a maximum rate of from about 62.5°F. to about 83°F. (from about 34.6°C. to about 46.1°C.) per hour to a temperature of about 1700°F. ( 927°C). Thereafter, the coils are subjected to an intermediate cooling step at the maximum rate of from about 19.8°F. to about 26.4°F. (from about 11.0°C. to about 14.7°C.) per hour to a temperature of about 1225°F. (663°C.). The coils are then subjected to a final fast cooling step at the maximum rate of from about 162.5°F. to about 243.8°F. (from about 90°C. to about 135.4°C.) per hour to a temperature of about 250°F (121°C). At this time, a vacuum is drawn within the enclosure and the heating chamber to remove the annealing atmosphere therefrom. Upon removal of the annealing atmosphere, the furnace enclosure and heating chamber is back filled with nitrogen, whereupon the furnace may be opened and the coils removed therefrom.

When a high permeability cube-on-edge oriented silicon steel is desired, the silicon-steel coils containing A1N as the grain growth inhibitor, substantially the same process may be followed including the step of soaking the coils at 1200°F. (649°C.) for about 6 hours prior to the soaking step at 2200°F. (1204°C.). When 30,000 pound coils are being treated, the upper ends of the above noted maximum cooling rate ranges may be used. Similarly, when 40,000 pound coils are used, the lower ends of the above noted maximum cooling rate ranges are employed.

BRIEF DESCRIPTION OF THE DRAWINGS

FIG. 2 illustrates graphically the process of the present invention, plotting minimum time in hours and temperature in degrees Fahrenheit.

DESCRIPTION OF THE PREFERRED EMBODIMENTS

Figure 1:
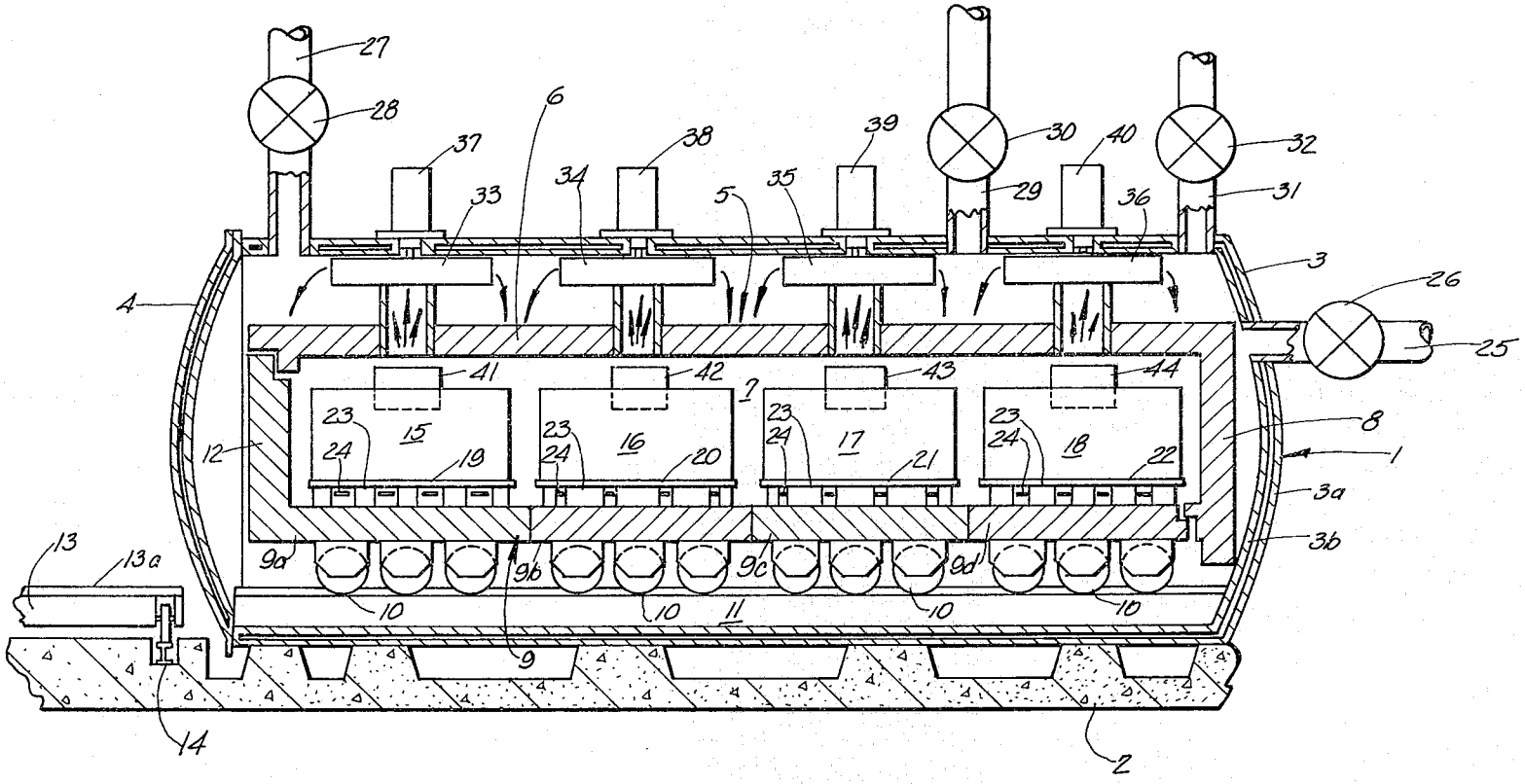
FIG. 1 is a semi-diagrammatic elevational view, partly in cross-section of a furnace of the type described in U.S. Pat. No. 3,588,305 and utilized in the process of the present invention.

For a complete understanding of the process of the present invention, reference is first made to FIG. 1 wherein a furnace of the type taught in U.S. Pat. No. 3,588,305 is semi-diagrammatically illustrated. In FIG. 1, the furnace is generally indicated at 1 and is shown mounted on an appropriate foundation 2. The furnace comprises an outer enclosure 3. While not so limited, the enclosure 3 may be double-walled, having outer wall 3*a* and inner wall 3*b* so that water may be circulated between the walls to cool and control the temperature of the outer enclosure. When the enclosure is water cooled, appropriate water inlet and outlet means (not shown) are provided, as is well known in the art. At its forward end, the enclosure is provided with a door 4 which may also be double-walled for water cooling. Means (not shown) may be provided to raise and lower the door between open and closed positions, again as is well known in the art.

Within the enclosure 1 there is a heating chamber generally indicated at 5. The chamber 5 comprises a top wall 6, side walls (one of which is shown at 7) and an end wall 8. This much of the heating chamber is appropriately supported within the furnace enclosure 1 by means not shown. The support means for this portion of the heating chamber may, themselves, be wheeled so as to ride upon rails enabling this portion of the heating chamber to be removed from the enclosure 1 for repair or the like.

A car, generally indicted at 9, is provided with a plurality of wheels, some of which are shown at 10, adapted to ride upon two or more rails (one of which is shown at 11). The car 9 is made up of four sections 9*a* through 9*d*, appropriately hooked together so that the entire car 9 may act as a single unit. The car 9, as will be evident from FIG. 1, constitutes the bottom of the heating chamber 5. Car section 9*a* carries an upstanding wall 12 comprising the forward wall of heating chamber 5. When the car 9 is fully within the enclosure 1 it will be noted that it completes the heating chamber 5. The front wall 12, rear wall 8, top wall 6 and side walls (one of which is shown at 7) of the heating chamber 5 may be made of or lined with any appropriate ceramic fiber refractory material as is well known in the art. The upper surface of the car 9 is also covered with an appropriate ceramic fiber refractory material.

For purposes of loading the heating chamber 5, the door 4 of the outer enclosure 1 can be shifted to its open position and the car 9 may be removed from the furnace and located upon a transfer carriage fragmentarily shown at 13. The carriage 13 rides on rails, one of which is shown at 14. The carriage, itself, is provided with transverse rails (one of which is shown at 13*a*) adapted to align with the rails 11 and to receive the wheels 10 of car 9. The car 9 then, via transfer carriage 13, may be taken to a loading station to receive coils to be annealed or to an unloading station to remove coils which have been annealed.

In FIG. 1 the car 9 is illustrated as carrying four silicon steel coils 15 through 18 mounted upon base plates 19 through 22, respectively. The base plates, themselves, are horizontally oriented and spaced upwardly from the insulative material on the upper surface of car 9 by support means 23.

Beneath the base plates 19 through 22 and above the ceramic fiber refractory material covering the top surface of the car 9 there is a plurality of heating elements 24 following a sinuous path between the supports 23. The inside surfaces of top wall 6 and the side walls of the heating chamber 5 may also be provided with heating elements (not shown) mounted thereon.

The interior of the outer enclosure 3 may be connected to an appropriate vacuum source by a conduit 25 controlled by a valve means 26. In this way, the furnace outer enclosure 3 and the heating chamber 5 may be evacuated. It will be understood by one skilled in the art that communication between the outer enclosure 3 and heating chamber 5 is accomplished either by passages in the heating chamber formed for that purpose, or by spaces between the bottom of the chamber (car 9) including front wall 12 and the remainder of the heating chamber, or both. Via conduit 27 controlled by valve 28 or conduit 29 controlled by valve 30 various desired atmospheres may be introduced into the outer enclosure 3 and heating chamber 5. Atmospheres so introduced will circulate through the outer enclosure and the heating chamber, exiting the outer enclosure via conduit 31, controlled by valve means 32. The conduit 31 may lead to an atomosphere recovery means or a flare stack, as is well known in the art.

To increase circulation within the heating chamber 5 and the outer enclosure 3, fans indicated at 33 through 36 may be provided. Motor means for the fans 33 through 36 are located exteriorly of the outer enclosure 3, as at 37 through 40, respectively. The fans 33 through 36 serve to draw atmosphere from the heating chamber 5 and return it to the outer enclosure 3. In the exemplary embodiment the fans are illustrated as being located at the top of the furnace. Alternatively, the fans could be located at one or both of the furnace sides. To further increase circulation of atmosphere within the heating chamber, the side walls of the chamber may be provided with automatically actuated bungs. Such bungs are illustrated in side wall 7 at 41 through 44.

As indicated above, the car 9 normally operates as a single unit. However, it is made up of the separate car sections **9*a* through 9*d*** which may be detached from each other for purposes of repair or the like.

As is taught in the above mentioned U.S. Pat. No. 3,588,305, in large installations a number of furnaces of the type illustrated in FIG. 1 may be employed with the transfer cart 13 serving them. The operation of the furnaces may be coordinated for purposes of loading, unloading and annealing by computer means which will govern the various annealing operations including times and temperatures. The computer means will control the opening and closing of the various valves 26, 28, 30 and 32 as well as turning on and off the heating elements within heating chamber 5. The actual control means for all of these elements, the number of furnaces used and the like, do not constitute a part of the present invention.

In accordance with the present invention, silicon steel is processed by any appropriate routing so as to produce during the final anneal an end product having the desired orientation utilizing sulfur, selenium or compounds thereof as a grain growth inhibitor. In the exemplary embodiment first to be described wherein the final product has a cube-on-edge orientation, the silicon steel is coated with an annealing separator such as magnesia, or the like, and is formed into coils weighing about 30,000 pounds. As indicated above, the particular routing followed prior to the final anneal does not constitute a limitation on the present invention.

In the description to follow of the annealing process reference is made to FIGS. 1 and 2. FIG. 2 illustrates the annealing process in graph form, plotting minimum times in hours and temperature in degrees Fahrenheit.

The coils, having been coated with an appropriate annealing separator, are located upon the base plates 19 through 22 and the car is located within the furnace outer enclosure 3, thereby completing the heating chamber 5. The door means 4 of the outer chamber is closed and the annealing procedure is ready to begin.

The first step of the procedure is to draw a vacuum within the furnace 1 to a level of about 500 microns. The vacuum is drawn through conduit 25 controlled by valve 26. All of the remaining valves 28, 30 and 32 are closed. The drawing of the vacuum will take a minimum of about 60 minutes. When the desired level of vacuum is reached the valve 26 is closed and the vacuum is held for a minimum of 2 minutes with all furnace valves closed. The purpose of this step is to remove all air from the furnace enclosure 3 and heating chamber 5. This step eliminates flushing of the enclosure 3 and heating chamber 5 with nitrogen or some other appropriate atmosphere.

At this point, with all other valves closed, valve 28 in conduit 27 is opened and hydrogen is backfilled into the outer enclosure 3 and heating chamber 5. The hydrogen is pure hydrogen at ambient temperature and fills the outer enclosure and heating chamber to a pressure of about 750 mm of mercury. This step takes a minimum of about 15 minutes. It will be understood by one skilled in the art that while the present process will be described in terms of using pure hydrogen as an annealing atmosphere, other annealing atmospheres such as hydrogen-nitrogen mixtures or vacuum annealing may be used. The use of other annealing atmospheres or a vacuum may require adjustment of other operating parameters, as will be understood by one skilled in the art.

At this point, valve 32 is opened in conduit 31 leading to the atmosphere recovery means or flare stack and hydrogen, still entering via conduit 27, is circulated through the outer enclosure 3 and heating chamber 5 at the rate of about 1100 cubic feet per hour. This circulation rate of the hydrogen is maintained throughout the heat-up step of the anneal. The circulating hydrogen removes the moisture from the annealing separator during this circulation step and the following heat-up step.

Once the hydrogen circulation has been established for about 10 minutes, the electrical heating elements of the furnace are turned on so as to heat the silicon steel coils at the rate of about 60°F. (34°C.) per hour until a temperature of about 2175°F. (1190°C.) is reached. The heat-up step takes a minimum of about 1850 minutes (30 hours and 50 minutes) as shown in FIG. 2 and on average will take about 34 hours and 10 minutes.

Once the heat-up step has been accomplished, the circulation of the annealing atmosphere or hydrogen in the outer enclosure 3 and heating chamber 5 will be reduced to about 400 cubic feet per hour. This flow rate will be maintained during both the soak step and the cooling steps. The heating elements are so controlled as to soak the silicon steel coils 15 through 18 at a temperature of 2200°F. (1204°c.) for a minimum of 1440 minutes (24 hours) as shown in FIG. 2.

Following completion of the soak step, the power is shut off to the electrical heating elements within the heating chamber and a three stage cooling procedure is started. Accordingly, the first step is an unassisted, slow cooling step which continues until the coils 15 through 18 reach a temperature of about 1700°F. (927°C.) and requires a minimum time of about 360 minutes (6 hours). This represents a maximum cooling rate of approximately 83°F. (46°C.) per hour.

When the coils reach approximately 1700°F. (927°C.) an intermediate cooling step is initiated. The bungs 41 through 44 of the heating chamber 5 remain closed and the fans 33 through 36 are turned on. The coils 15 through 18 are cooled to about 1225°F. (663°C.). This intermediate cooling step requires a minimum of about 1080 minutes (18 hours). This represents a maximum cooling rate of approximately 26.4°F. (14.7°C) per hour.

When the coils reach approximately 1225°F. (663°C.) and after a one minute hold to stabilize the furnace pressure, a final fast cooling step is initiated with fans 33 through 36 remaining on and bungs 41 through 44 open. Coils 15 through 18 are cooled to about 250°F. (121°C.) in a minimum time of about 4 hours, representing a maximum cooling rate of about 243.8°F. (135.4°C.) per hour.

The times given above for the cooling steps are minimum times as shown in FIG. 2. In practice, these three steps average approximately 420 minutes (7 hours), 1200 minutes (20 hours) and 360 minutes (6 hours), respectively, with average cooling rates of 71.4°F. (39.6°C.), 23.8°F. (13.2°C.) and 162.5°F. (90.3°C.) per hour, respectively.

When the coils reach the temperature of approximately 250°F. (121°C.) the bungs 41 through 44 are closed, valves 28 and 32 are closed (i.e. all valves are closed) and the fans 33 through 36 are turned off. This step takes a minimum of about 2 minutes. Thereafter, a vacuum is drawn by opening valve 26 in conduit 25. The vacuum is drawn to a level of about 500 microns. This step takes a minimum of about 50 minutes. Once the vacuum has been established, the valve 26 in conduit 25 is closed and the vacuum is held with all valves of the furnace closed for a minimum of about 2 minutes. These vacuum and hold steps cause all of the hydrogen or other annealing atmosphere used to be removed from the outer enclosure 3 and heating chamber 5.

Next, valve 30 in conduit 29 is opened, backfilling the outer enclosure 3 and heating chamber 5 with nitrogen or an appropriate inert gas. The nitrogen is introduced until it attains a pressure of about 740 mm of mercury. This step takes approximately 15 minutes. Upon completion of the nitrogen backfill, the cycle is completed and the door means 4 of the furnace may be opened. The car 9 carrying coils 15 through 18 may be removed from the outer enclosure 3 onto the transfer car 13 to be taken to an appropriate unloading station for the annealed coils. The minimum time required for this annealing procedure is 5128 minutes (85 hours 28 minutes). It has been found that the average overall time for the annealing procedure is about 90 hours.

The various time and temperature milestones which are programmed for the computer means are developed to produce the desired final product. For example the size of the charge will have a bearing. Thus, if silicon steel of the type set forth in the previously described exemplary embodiment is annealed in accordance with the present invention in coils weighing 40,000 pounds (rather than 30,000 pounds), all of the milestones and procedural steps remain the same with the exception of the minimum times required for the three cooling steps and thus the maximum rates of these steps. This is shown in FIG. 3.

The initial slow cooling step from 2200°F. to 1700°F. (1204°C. to 927°C.) requires a minimum of about 480 minutes (8 hours representing a maximum cooling rate of about 62.5°F. (34.6°C.) per hour. The intermediate cooling step from 1700°F. to 1225°F. (927°C. to 663°C.) takes a minimum time of about 1440 minutes (24 hours) at a maximum rate of about 19.8°F. (11.0°C.) per hour. After a one minute holding period to stabilize the furnace pressure prior to opening the bungs, the final fast cooling step from 1225°F. to 250°F. (663°C. to 121°C.) requires a minimum time of about 360 minutes (6 hours) at a maximum rate of about 162.5°F. (90.3°C.) per hour.

Figure 3:
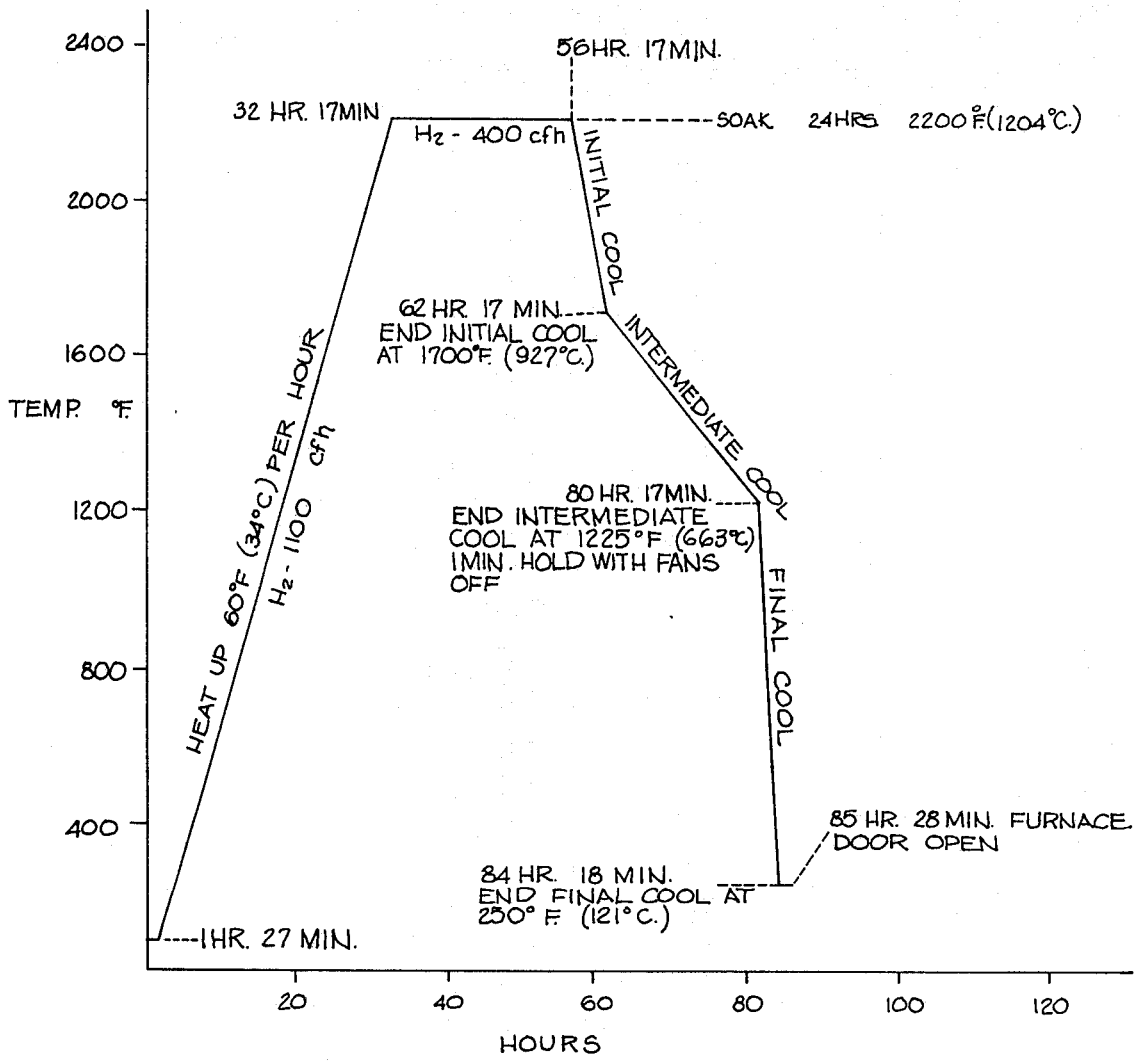
FIG. 3 illustrates graphically another embodiment of the process of the present invention, again plotting minimum time in hours and temperature in degrees Fahrenheit.
Figure 3:
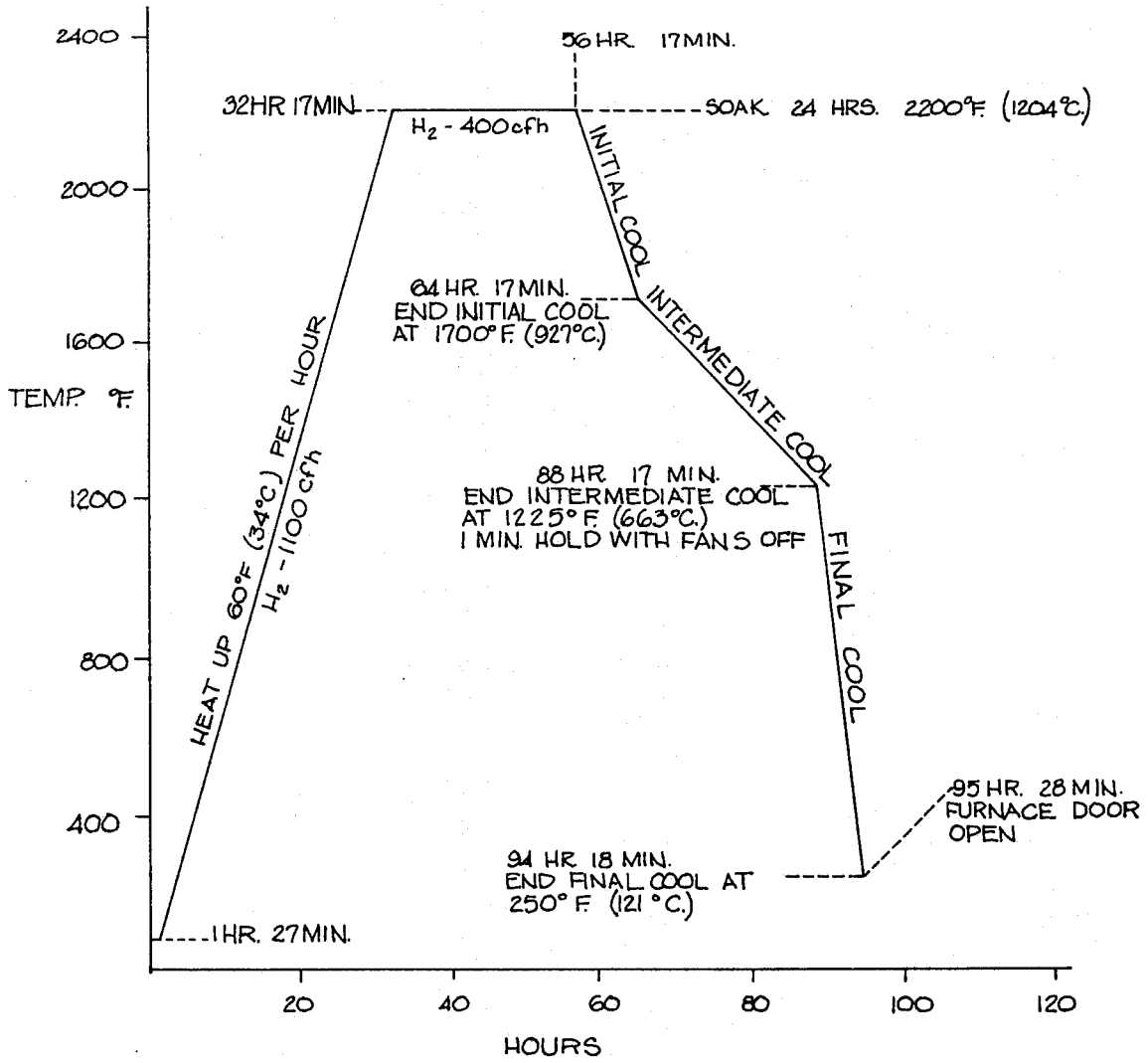

The times given above for the cooling steps are minimum times (as shown in FIG. 3). In practice these three steps average approximately 540 minutes (9 hours), 1560 minutes (26 hours) and 480 minutes (8 hours), respectively, with average cooling rates of 55.5°F. (30.8°C.), 18.3°F. (10.2°C.) and 122°F. (67.8°C.), respectively.

With 40,000 pound coils the minimum time required for the annealing procedure is 5728 minutes (95 hours, 28 minutes). It has been found that the average overall time for the annealing procedure is about 100 hours.

The exemplary annealing procedures thus far described are applicable without change for the annealing of cube-on-face oriented silicon steel provided with an appropriate annealing separator and coiled into 30,000 pound or 40,000 pound coils.

Figure 4:
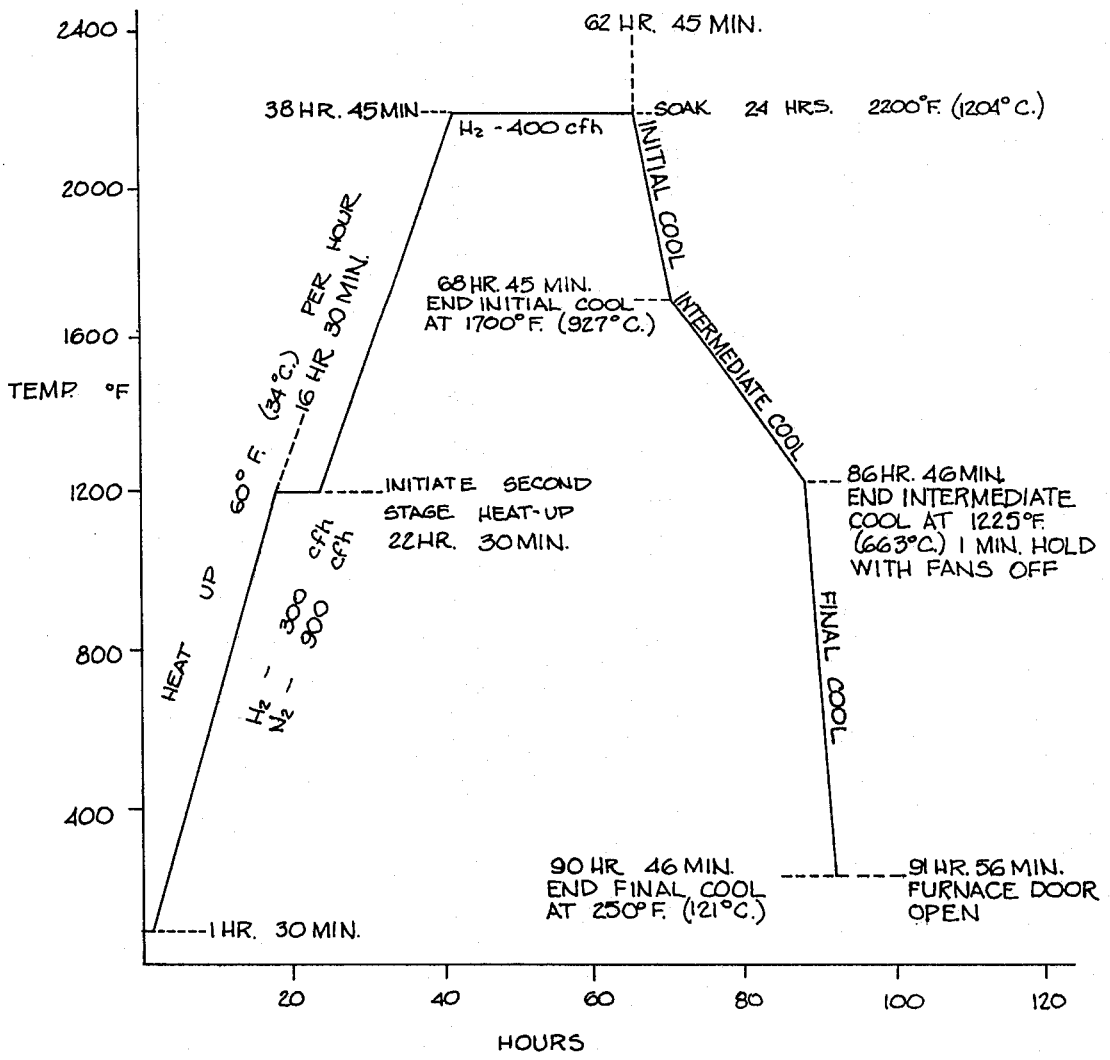
FIGS. 4 and 5 are similar to FIGS. 2 and 3 and illustrate graphically yet other embodiments of the process of the present invention.

Depending upon the type of charge in the heating chamber, modifications may be required in the computer milestones. For example, when it is desired to make a high permeability cube-on-edge oriented silicon-steel and when the silicon steel contains A1N as the grain growth inhibitor, it is preferable to modify the above described annealing process as shown in FIG. 4. Again, 30,000 pound coils, having been coated with an appropriate annealing separator, are located upon base plates 19 through 22 on the car and are shifted within the heating chamber 5, after which the outer chamber is closed. A vacuum is drawn within the furnace 1 and is held therein in the same manner described above. After a holding period of at least 2 minutes the furnace is backfilled with hydrogen again in the same manner described above. This step will take a minimum of about 18 minutes.

At this point, valve 32 is opened in conduit 31 leading to the atmosphere recovery means or flare stack and a hydrogen-nitrogen mixture is circulated through the outer enclosure 3 and heating chamber 5. The nitrogen is circulated at the rate of about 900 cubic feet per hour and the hydrogen is circulated at the rate of about 300 cubic feet per hour. These circulation rates for the hydrogen and nitrogen are maintained throughout the two-stage heat-up and intermediate hold of the anneal, next to be described. This 3 to 1 nitrogen to hydrogen ratio is used during heat-up to preserve the A1N grain growth inhibitor.

Once the circulation for these gases has been established for about 10 minutes, the electrical heating elements of the furnace are turned on so as to heat the silicon steel coils at the rate of about 60°F. (34°C.) per hour until a temperature of about 1200°F. (649°C.) is achieved. This initial heat-up stage will require a minimum of about 900 minutes (15 hours). The coils are held at 1200°F. (649°C.) for a minimum of 360 minutes (6 hours). The purpose of this intermediate soak is to obtain a lower dewpoint (i.e. a dryer furnace atmosphere) prior to heating to higher temperatures. Thereafter, the temperature is increased at the same rate to about 2175°F. (1190°C.). This second stage heat-up will require a minimum of 975 minutes (16 hours, 15 minutes).

Once the first and second stage heat-up steps have been accomplished, including the intermediate temperature hold, the annealing atmosphere is changed to hydrogen only in the outer enclosure 3 and heating chamber 5 and will be circulated therein at a rate about 400 cubic feet per hour. This low rate will be maintained during both the soak step and the cooling steps. The heating elements are controlled so as to soak the silicon steel coils at a temperature of 2200°F. (1204°C.) for a minimum of 1440 minutes (24 hours) as shown in FIG. 4.

Following the soak step, the silicon steel coils are cooled in three steps substantially identical to those described above with respect to ordinary cube-on-edge silicon steel in 30,000 pound coils (see FIGS. 2 and 4) with the same maximum and average cooling rates. Once the coils attain a temperature of approximately 250°F. (121°C.) the same procedures will be followed as described in the previous exemplary embodiment, of 30,000 pound coils. The minimum time for the annealing of the A1N-containing 30,000 pound coils is 5516 minutes (91 hours, 56 minutes), the average overall time for the annealing procedure being about 96 hours.

Figure 5:
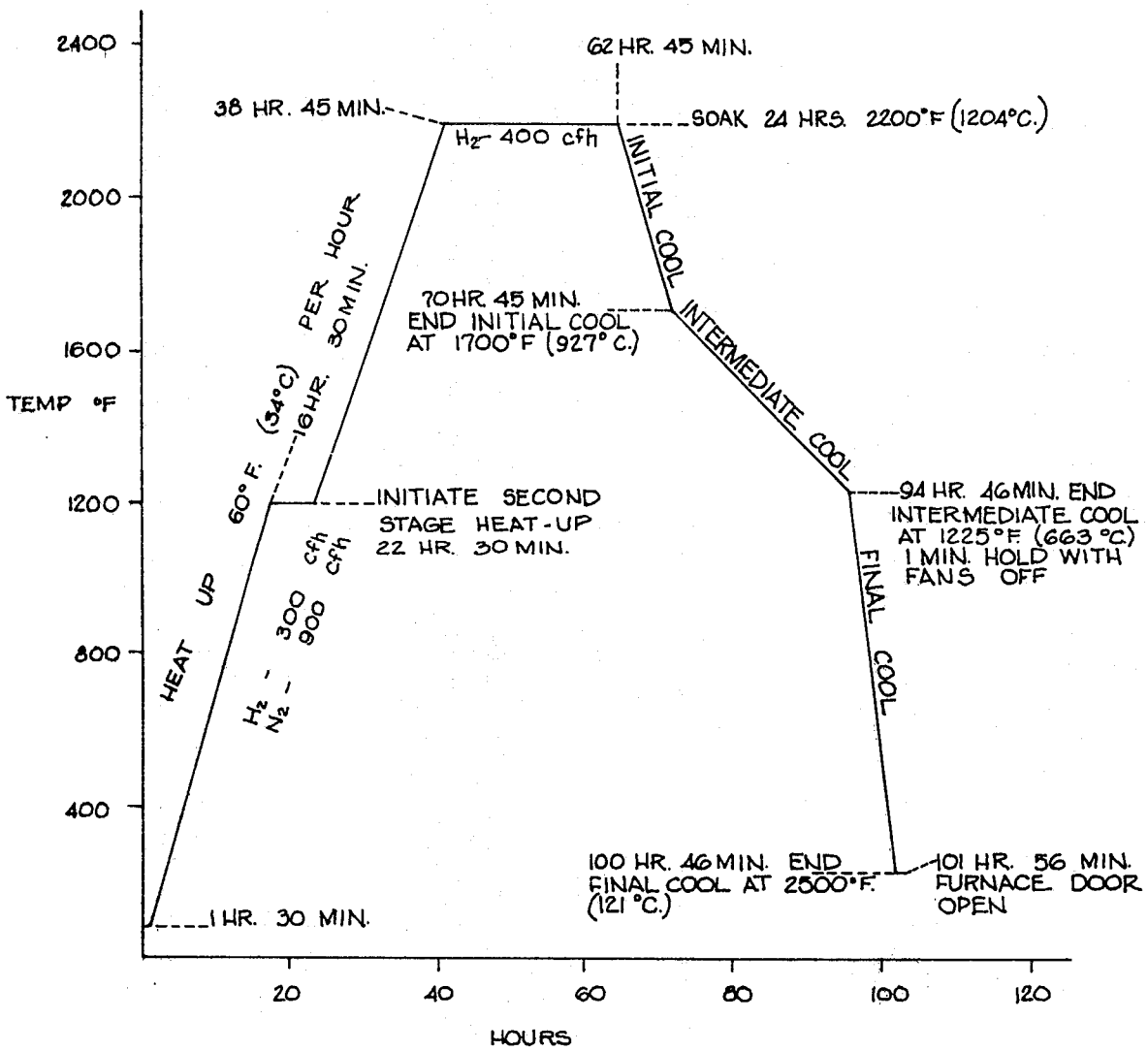

When 40,000 pound coils of A1N-containing silicon steel are to be annealed to produce a cube-on-edge product, the preliminary and heat up steps will be the same as just described. The three step cooling procedures and steps that follow will be the same as those described above for 40,000 pound coils of ordinary silicon steel (see FIG. 5). The minimum time for the annealing of A1N-containing 40,000 pound coils is 6116 minutes (101 hours, 56 minutes), the average overall time being 106 hours.

In the procedures set forth above, the minimum times have been selected and programmed as a safeguard to assure that a minimum time is provided for each step as indicated. The rates associated with these minimum times are therefor maximum rates. The above noted average times are indicative of formal operating conditions. In practice, the times (including heat-up and cooling times) will vary slightly between furnaces and annealing cars and can additionally vary (as shown above) depending upon the weight of and the nature of the coils charged in the furnace.

Modifications may be made in the invention without departing from the spirit of it.

The embodiments of the invention in which an exclusive property of privilege is claimed are defined as follows:

1. A batch-type method of annealing large coils of silicon steel for magnetic purposes having a weight of from about 30,000 to about 40,000 pounds in an annealing furnace of the type comprising an outer enclosure surrounding an insulated heating chamber in which said coils are supported, said furnace being capable of subjecting said coils both to a desired atmosphere and a vacuum, said method comprising the steps of locating said coils to be annealed in said furnace heating chamber, drawing and holding a vacuum within said outer enclosure and said heating chamber to remove air therefrom, backfilling said outer enclosure and said heating chamber with a desired non-oxidizing annealing atmosphere, circulating said annealing atmosphere through said outer enclosure and said heating chamber, heating said coils to a temperature of about 2200°F. and soaking said coils at said temperature with continued circulation of said annealing atmosphere, cooling said coils in three steps comprising an initial cooling step from 2200°F. (1204°C.) to 1700°F. (927°C.), an intermediate cooling step from 1700°F. (927°C.) to 1225°F. ( 663°C.) and a final cooling step from 1225°F. (663°C.) to 250°F. (121°C.) with continued circulation of said annealing atmosphere, drawing and holding a vacuum within said outer enclosure and said heating chamber to remove said annealing atmosphere therefrom, backfilling said enclosure and said heating chamber with a gas which will not support combustion in the presence of said annealing atmosphere and removing said coils from said furnace.

2. The method claimed in claim 1 wherein said annealing atmosphere is hydrogen.

3. The method claimed in claim 1 wherein said gas which will not support combustion in the presence of said annealing atmosphere is nitrogen.

4. The method claimed in claim 1 wherein said heating of said coils to about 2200°F. (1204°C.) is conducted at a rate of about 60°F. (34°C.) per hour.

5. The method claimed in claim 1 wherein said coils are soaked at temperature for about 24 hours.

6. The method claimed in claim 1, wherein said coils weigh about 30,000 pounds and said three cooling steps are conducted at maximum rates of 83°F. (46.1°C.), 26.4°F. (14.7°C.) and 243.8°F. (135.4°C.) per hour, respectively.

7. The method claimed in claim 1 wherein said coils weigh about 40,000 pounds and said three cooling steps are conducted at maximum rates of 62.5°F. (34.6°C), 19.8°F. (11.0°C.) and 162.5°F. (90.3°C.) per hour respectively.

8. The method claimed in claim 1, wherein said silicon steel contains A1N as a grain growth inhibitor and is intended to achieve a cube-on-edge orientation and including the steps of subjecting said coils to a first stage heat-up step to a temperature of about 1200°F. (649°C.), holding said coils at said last mentioned temperature, thereafter subjecting said coils to a second stage heat-up step to said soak temperature of about 2200°F. (1204°C.), maintaining a hydrogen-nitrogen atmosphere in said outer enclosure and said heating chamber during said first and second stage heat-up steps and maintaining a hydrogen atomsphere during said soak and said slow and fast cooling steps.

9. The method claimed in claim 8, wherein said gas which will not support combustion in the presence of said annealing atmosphere is nitrogen.

10. The method claimed in claim 8 wherein said first and second heat-up steps are conducted at the rate of about 60°F. (34°C.) per hour.

11. The method claimed in claim 8 wherein said coils are held at about 1200°F. (649°C.) for about 6 hours and are soaked at about 2200°F. (1204°C.) for about 24 hours.

12. The method claimed in claim 8 wherein said coils weigh about 30,000 pounds and said three cooling steps are conducted at maximum rates of 83°F. (46.1°C.), 26.4°F. (14.7°C.) and 243.8°F. (135.4°C.) per hour, respectively.

13. The method claimed in claim 8 wherein said coils weigh about 40,000 pounds and said three cooling steps are conducted at maximum rates of 62.5°F. (34.6°C.), 19.8°F. (11.0°C.) and 162.5°F. (90.3°C.) per hour, respectively.

* * * * *